US008414403B2

(12) United States Patent
Denham et al.

(10) Patent No.: US 8,414,403 B2
(45) Date of Patent: Apr. 9, 2013

(54) SECURED GAMING TABLE VOUCHERING SYSTEM

(75) Inventors: Rob Denham, Reading (GB); Eric Meyerhofer, Pasadena, CA (US)

(73) Assignee: FutureLogic, Inc., Glendale, CA (US)

( * ) Notice: Subject to any disclaimer, the term of this patent is extended or adjusted under 35 U.S.C. 154(b) by 0 days.

(21) Appl. No.: 12/530,892

(22) PCT Filed: Mar. 12, 2008

(86) PCT No.: PCT/US2008/056752
§ 371 (c)(1),
(2), (4) Date: Jan. 19, 2010

(87) PCT Pub. No.: WO2008/112832
PCT Pub. Date: Sep. 18, 2008

(65) Prior Publication Data

US 2010/0167811 A1 Jul. 1, 2010

Related U.S. Application Data

(60) Provisional application No. 60/026,723, filed on Feb. 6, 2008, provisional application No. 60/894,427, filed on Mar. 12, 2007.

(51) Int. Cl.
*A63F 9/24* (2006.01)

(52) U.S. Cl. ..... 463/46; 463/13

(58) Field of Classification Search ..... 463/13, 463/46
See application file for complete search history.

(56) References Cited

U.S. PATENT DOCUMENTS

| | | | | |
|---|---|---|---|---|
| 6,012,832 | A * | 1/2000 | Saunders et al. | 235/375 |
| 6,280,326 | B1 * | 8/2001 | Saunders | 463/25 |
| 6,500,067 | B1 * | 12/2002 | Luciano et al. | 463/25 |
| 7,419,428 | B2 * | 9/2008 | Rowe | 463/25 |
| 2004/0132529 | A1 * | 7/2004 | Mkrtchyan et al. | 463/29 |
| 2006/0068869 | A1 * | 3/2006 | White et al. | 463/13 |

* cited by examiner

*Primary Examiner* — David L Lewis
*Assistant Examiner* — Shauna-Kay Hall
(74) *Attorney, Agent, or Firm* — Frank L. Cire

(57) ABSTRACT

A secured gaming table vouchering system to enable the use of game vouchers and promotional coupons and cashless gaming at gaming tables such as a poker table and a gaming table device for use therein. The secured gaming table vouchering system and gaming table device allows casinos and other types of gambling establishments to link gaming tables and point of sale terminals in or associated with a casino to connect and use systems in use, such as the TITO (Ticket In Ticket Out) host system, for credit transfer from cash, RFID chips, non-RFID chips, gaming vouchers, and promotional coupons to gaming vouchers and promotional coupons thereby expanding the use of credit transfer within a gaming establishment and or associated gaming establishments and their slot machines, change machines, and cashier cages.

11 Claims, 7 Drawing Sheets

SECURED GAMING TABLE VOUCHERING SYSTEM

CROSS-REFERENCE TO RELATED APPLICATIONS

The present application claims the benefit of U.S. Provisional Application Nos. 60/894,427 filed Mar. 12, 2007 and 61/026,723 filed Feb. 6, 2008, the contents of each of which are incorporated by reference as if stated in full herein.

BACKGROUND OF THE INVENTION

1. Field of the Invention

This invention relates to cashless gaming, more specifically to cashless gaming at table games.

2. Background

The gaming machine manufacturing industry provides a variety of gaming machines for the amusement of gaming machine players. An exemplary gaming machine is a slot machine. A slot machine is an electro-mechanical game wherein chance or the skill of a player determines the outcome of the game. Slot machines are usually found in casinos or other more informal gaming establishments.

Gaming machine manufacturers have introduced cashless enabled games such as a slot machine to the market and these have begun to find wide acceptance in the gaming industry. Cashless enabled games are so named because they can conduct financial exchanges using a mixture of traditional currencies and vouchers. Typically, a cashless enabled game has a gaming table device to produce vouchers and a voucher reader that supports automatic reading of vouchers. To coordinate the activities of multiple cashless enabled games, one or more cashless enabled games may be electronically coupled to a cashless enabled game system that controls the cashless operations of a cashless enabled game.

Over the last several years, cashless enabled games have found an increasing acceptance and use in the gaming industry with both the players, who enjoy the speed of play and ease of transporting their winnings around the casino, and the casinos who have realized significant labor savings in the form of reduced coin hopper reloads in the games, and an increase in revenue due to speed of play. Practical field experience with the application has illustrated that there are areas for improvement in current cashless systems.

One such area for improvement is how to use and exchange vouchers generated by cashless enabled game at a gaming table such as a poker table. Additionally, there exists a need to provide cashless payout from a gaming table.

This invention provides a solution for these needs.

Definitions

For the purposes of this document, the following definitions apply:

- "Gaming Establishment"—A gaming entity such as a casino or other place where gambling takes place.
- "Game", "Gaming Machine", or "Game Machine"—A gaming table or gaming machine such as any electro-mechanical game of chance. A Slot Machine is a sub-set of such games.
- "Printer"—A printing device coupled to a Game, a vending machine or kiosk, or a point-of-sale (POS) system.
- "Voucher"—Media, such as paper or rewritable card, containing sufficient information to identify at a minimum, an amount of money and a validation number used to authenticate the transaction.
- "Promotional Coupon"—Media, such as paper or rewritable card, containing sufficient information to identify at a minimum, a promotional event or a promotional reward to a player and validation information.
- "Rewritable Card"—Media such as a smart card, magnetic media, thermal media, thermal reversible media, RF fiber media, RFID tag media, or write once media which is used for game vouchers and promotional coupons.
- "Host System"—A computer, back-end system, gaming system, network, or other system that sends and/or receives information to and/or from a printer or other component in a cashless enabled game or gaming table. Examples of a host system include a wagering issuance and redemption system, a player tracking system, and a promotional couponing system, among others.
- "Point of Redemption"—Any kiosk, point-of-sale, cashier's cage, or other means whereby a player can redeem a game voucher or promotional coupon.
- "RFID Chip"—A type of token used at gaming tables in lieu of cash which contain a Radio Frequency circuit that can hold information and does not require a direct electrical connection as an interface connection.
- "TITO"—Acronym for Ticket In, Ticket Out, a form of cashless enabled gaming.
- "SMIB"—Acronym for Slot Machine Interface Board, the board used to manage transactions of a slot machine, such as money in, money out, bills and tickets inserted, jackpots paid, etc.
- "PTS"—Acronym for Player Tracking System. The system installed at a gaming establishment that is used to monitor game play activity by participating patrons. A PTS is a rudimentary part of the existing casino industry architecture.
- "Cash-Out Vouchering System"—The system installed at a gaming establishment that is used to create cash-out voucher records and issue data packets which are used by a printer in a game to print a cash-out voucher. A Cash-Out Vouchering System is a rudimentary part of an existing casino industry architecture for casinos supporting cashless gaming.

SUMMARY OF THE INVENTION

A secured gaming table vouchering system to enable the use of game vouchers and promotional coupons and cashless gaming at gaming tables such as a poker table and a gaming table device for use therein is provided. The secured gaming table vouchering system and gaming table device allows casinos and other types of gambling establishments to link gaming tables and point of sale terminals in or associated with a casino to connect and use systems in use, such as the TITO (Ticket In Ticket Out) host system, for credit transfer from cash, RFID chips, non-RFID chips, gaming vouchers, and promotional coupons to gaming vouchers and promotional coupons thereby expanding the use of credit transfer within a gaming establishment and or associated gaming establishments and their slot machines, change machines, and cashier cages.

In one aspect of the invention, a secured gaming table vouchering system may include one or more of gaming tables such as a poker table, each table coupled to a gaming table device, voucher scanning device, an interface, an interface to one or more of host systems, and a keypad, among others.

In another aspect of the invention, a secured gaming table vouchering system may include a gaming table device coupled to a gaming table; the gaming table device generates game vouchers and/or promotional coupons.

In another aspect of the invention, a gaming table device for a secured gaming table vouchering system may be coupled to a controller; the controller may be internal or external to the gaming table device.

In another aspect of the invention, a gaming table device for a secured gaming table vouchering system may be coupled to an interface; the interface interfaces with one or more of host systems.

In another aspect of the invention, a gaming table device for a secured gaming table vouchering system sends and receives signaling from one or more of host systems to generate a game voucher.

In another aspect of the invention, a gaming table device for a secured gaming table vouchering system sends and receives signaling from one or more of host systems to generate a promotional coupon.

In another aspect of the invention, a gaming table device for a secured gaming table vouchering system sends and receives signaling from one or more of host systems, the signaling may include the completion of a print job such as a game voucher or a promotional coupon, and printer status such as paper low, among others.

In another aspect of the invention, a gaming table device for a secured gaming table vouchering system includes an interface to one or more of host systems, the interface is used to send and receive signaling from one or more of host systems, the signaling may include a security code or authentication code for the verification and/or validation of the issuance and redemption of game vouchers and/or promotional coupons at a gaming table.

In another aspect of the invention, a gaming table device interfaces with one or more of host systems for transmitting data related to game vouchers, game voucher transactions, promotional coupons, promotional coupon transactions, a combination of any, or a combination of all.

In one aspect of the invention, a gaming table device may include a barcode reader or scanner, a ticket printer, a RFID sensing and/or reading mechanism, a controller, a keypad, a user interface, an external display, and an entry point, among others wherein any or all of these components may be internal or external to the gaming table device.

In another aspect of the invention, a gaming table device may be coupled to a barcode reader or scanner that upon receiving a cash-in or coupon-in signal scans the barcode of a gaming voucher and/or one or more of promotional coupons, the barcode data being transmitted to one or more of host systems for validation and verification.

In another aspect of the invention, a gaming table device may be coupled to a ticket or voucher printer that upon receiving a cash-out signal generates a gaming voucher and/or one or more of promotional coupons, the cash-out data being transmitted to one or more of host systems.

In another aspect of the invention, a gaming table device may be coupled to a RFID sensing and/or reading mechanism which would allow an RFID read of the RFID chips when the RFID chips are compiled or placed in a specified region on a gaming table, the RFID read of the chips signaling the gaming table device as to the amount of the cash-out, the amount being recorded in the memory of the gaming table device and posted to the external display of the gaming table device.

In another aspect of the invention, a gaming table device may be coupled to a keypad to receive input such as a cash-in amount, a verification number, or a validation number, among others.

In another aspect of the invention, a gaming table device may be coupled to a user interface such as feedback lights to provide signaling which someone such as an operator or dealer might otherwise miss.

In another aspect of the invention, a gaming table device may be coupled to an external display to provide visual means for data verification and/or validation, among others.

In another aspect of the invention, a gaming table device may include an entry point or a lit ring into which to push the chips, the entry point or lit ring flashing providing signaling to the dealer, among others.

In another aspect of the invention, a gaming table device may be coupled to any one or combination of the following systems: an accounting system, a TITO system, a Slot Machine Interface Board (SMIB), a Player Tracking System (PTS), a gaming chip issuance/redemption and/or tracking system, a promotional couponing system, a cash-out vouchering system, a point-of-sale system (POS), and other(s), among others.

In another aspect of the invention, a gaming table device may be coupled to a TITO system or any other system in any one or more of means such as a direct connection, indirectly through another coupled system, or through a slot machine interface board (SMIB), wherein the connection may use standard or nonstandard slot machine protocol.

In another aspect of the invention, a gaming table device may be coupled to a TITO system or any other system via a serial connection, a network connection, a wireless communication or any combination thereof.

BRIEF DESCRIPTION OF THE DRAWINGS

These and other features, aspects, and advantages of the present invention will become better understood with regard to the following description and accompanying drawings where.

Figure 1:
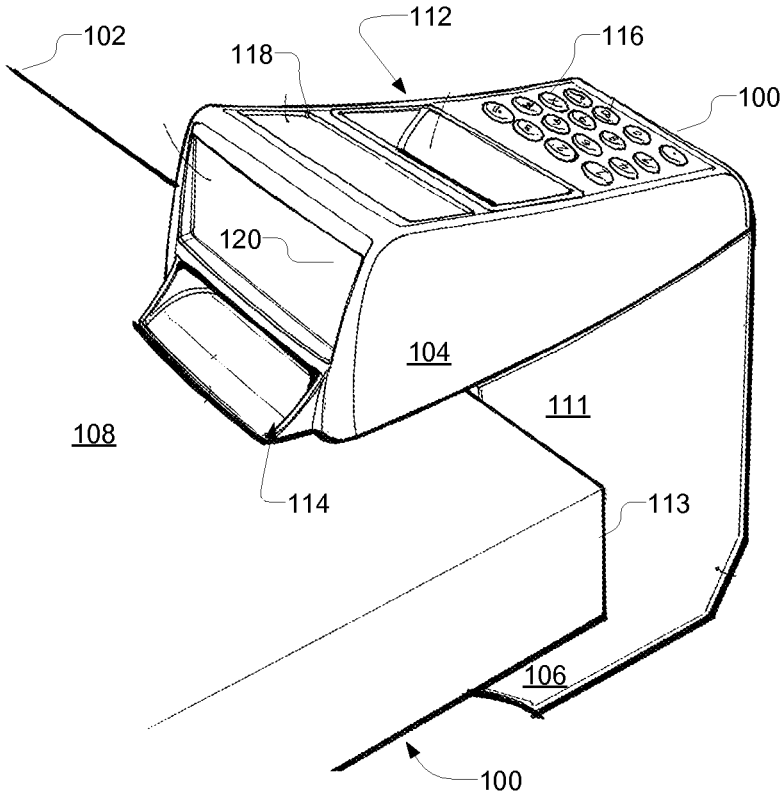
FIG. 1 is a perspective drawing of a gaming table device in accordance with an exemplary embodiment of the present invention.

DETAILED DESCRIPTION OF THE INVENTION printers, voucher scanners, and other devices to enable the use of game vouchers and promotional coupons and cashless gaming at gaming tables. The printer prints financial transaction records such as game vouchers and promotional coupons while the voucher scanner scan the barcode of each game voucher and/or promotional coupon for validation and/or verification with one or more host systems. A keypad and interface provides the secured validation and/or verification of game vouchers and promotional coupons. This invention relates to gaming and casinos, more specifically to cashless enabled gaming device using ticket-in and ticket-out and RFID technology which allows casinos and other types of gambling establishments to link gaming tables and point of sale terminals in or associated with a casino to connect and use systems in use, such as the TITO (Ticket In Ticket Out) host system, for credit transfer from cash, RFID chips, non-RFID chips, gaming vouchers, and promotional coupons to gaming vouchers and promotional coupons thereby expanding the use of credit transfer within a gaming establishment and or associated gaming establishments and their slot machines, change machines, and cashier cages.

More recently, casino chips containing RFID technology have been introduced. These chips provide for an automated means by which to track patron winnings and dealer tips, among others.

Practical field experience with cashless enabled gaming and components thereof has illustrated that there are areas for improvement in the design and implementation.

For example, currently there are no means by which to transfer credits or winnings from a gaming table into cashless form such as a gaming voucher for use in other games such as slot machines. There are no means by which to issue a gaming voucher from gaming table winnings to replace or compliment issuing traditional currency or gaming chips.

Additionally, gaming tables are not connected with other systems (such as accounting, POS) in use at a gaming establishment.

Another problem with the current situation is that gaming vouchers issued from cashless enabled games cannot be redeemed at a gaming table. Customers with winnings in the form of gaming vouchers must redeem the gaming vouchers for cash in order to use play those winnings at a gaming table. Gaming establishments run the risk that these customers will leave the gaming establishment instead of continuing to play. This in turn leads to reduced and lost revenue for the gaming establishment.

This invention provides a solution to these problems by enabling cashless gaming in gaming tables, the transfer of credits for the redemption of gaming vouchers issued from cashless enabled games, the issuance of a gaming voucher from winnings at a gaming table and the connection of gaming tables with other systems in use (such as accounting, POS).

One benefit in using this invention is that gaming machine cashout vouchers can be used on a gaming table thereby allowing players to transfer and use winnings from a slot machine on a gaming table and vise versa.

FIG. 1 is a perspective drawing of a gaming table device in accordance with an exemplary embodiment of the present invention. The gaming table device 100 is shown mounted to a gaming table 102. The gaming table device has an outer housing having an upper portion 104 that extends over a playing surface 108 of the gaming table, a lower portion 106 that extends below a lower surface 110 of the gaming table, and a middle portion 111 adjacent to an edge surface 113 of the gaming table between the upper portion and the lower portion. The upper portion 104 of the gaming table device has a first opening 112 accessible to a dealer at the gaming table and a second opening 114 accessible to a player at the gaming table. The upper portion of the gaming table device further includes a keypad or keyboard 116 proximate to the first opening for use by the dealer and a dealer display 118 viewable by the dealer. The upper portion also includes a player display 120 proximate the second opening and viewable by the player.

In operation, the player presents paper currency, vouchers, RFID chips or RFID cards to the dealer for cashing in to a game played at the gaming table. In the case of cash and vouchers, the dealer inserts the paper currency or vouchers into the first opening 112 for validation by the gaming table device 100. In the case of chips or cards, the player inserts the RFID chips or RFID card into the second opening 114 for verification or validation by the gaming table device. Upon verification or validation by the gaming table device, an appropriate amount of credit is made available for play at the gaming table. Upon completion of the game, the dealer uses the keypad 116 to initiate a cashout of the player. In response to the dealer's input, the gaming table device prints a voucher for presentation to the player via the second opening.

In the operation of one embodiment, when a player with credit and/or winnings in a gaming machine cashes out of the gaming machine, the player receives media such as a game voucher containing the appropriate cashout value such as in dollars. If the player decides to play at another gaming table, the player can insert the same game cashout voucher into the bill validator or voucher scanning device of another gaming table device. The voucher scanning device scans the inserted game cashout voucher. Additionally, the keypad, interface such as a display, and security code is used with one or more of host systems to verify and/or validate an inserted game cashout voucher. If accepted, any or all the amount from the value of the inserted game cashout voucher may be played at the gaming table by the player.

When the player with credit and/or winnings at the gaming table cashes out of the gaming table, a keypad, interface such as a display, and security code is used with one or more of host systems to verify and/or validate a game voucher generated at the gaming table. In turn, the player may take the game voucher generated at the gaming table and play the game voucher in a gaming machine, another gaming machine, the same gaming table, or another gaming table. Additionally, the player may cashout the game voucher at a point of redemption.

In the operation of another embodiment, the media may be a promotional coupon.

In the operation of another embodiment, the security code may be entered by the player or any authorized personnel at a gaming table.

In another embodiment, the means for a keypad and interface with display may include a touch screen display.

In the operation of another embodiment, when a player wants to cashout the gaming table, the player may press a cashout button which functions similar to that of a slot machine after which a printer coupled to the gaming table generates a game cashout voucher containing the appropriate cashout value such as in dollars.

In the operation of one embodiment of a gaming table device, the gaming table device may be coupled to a gaming table for the transfer of credits in the form of gaming vouchers, to generate gaming vouchers and or promotional coupons other items of interest to patrons of a gaming establishment and or associated gaming establishments.

In the operation of another embodiment, a gaming table device is coupled to a point-of-sale system to generate promotional coupons and other items of interest to patrons of a gaming establishment and or associated gaming establishments.

The gaming table device sends and receives signaling from one or more host systems to generate game vouchers and/or promotional coupons. Additionally, the signaling may include the completion of a print job such as a game voucher or promotional coupon and printer status such as paper low, among other types of operational or status signals.

Figure 2:
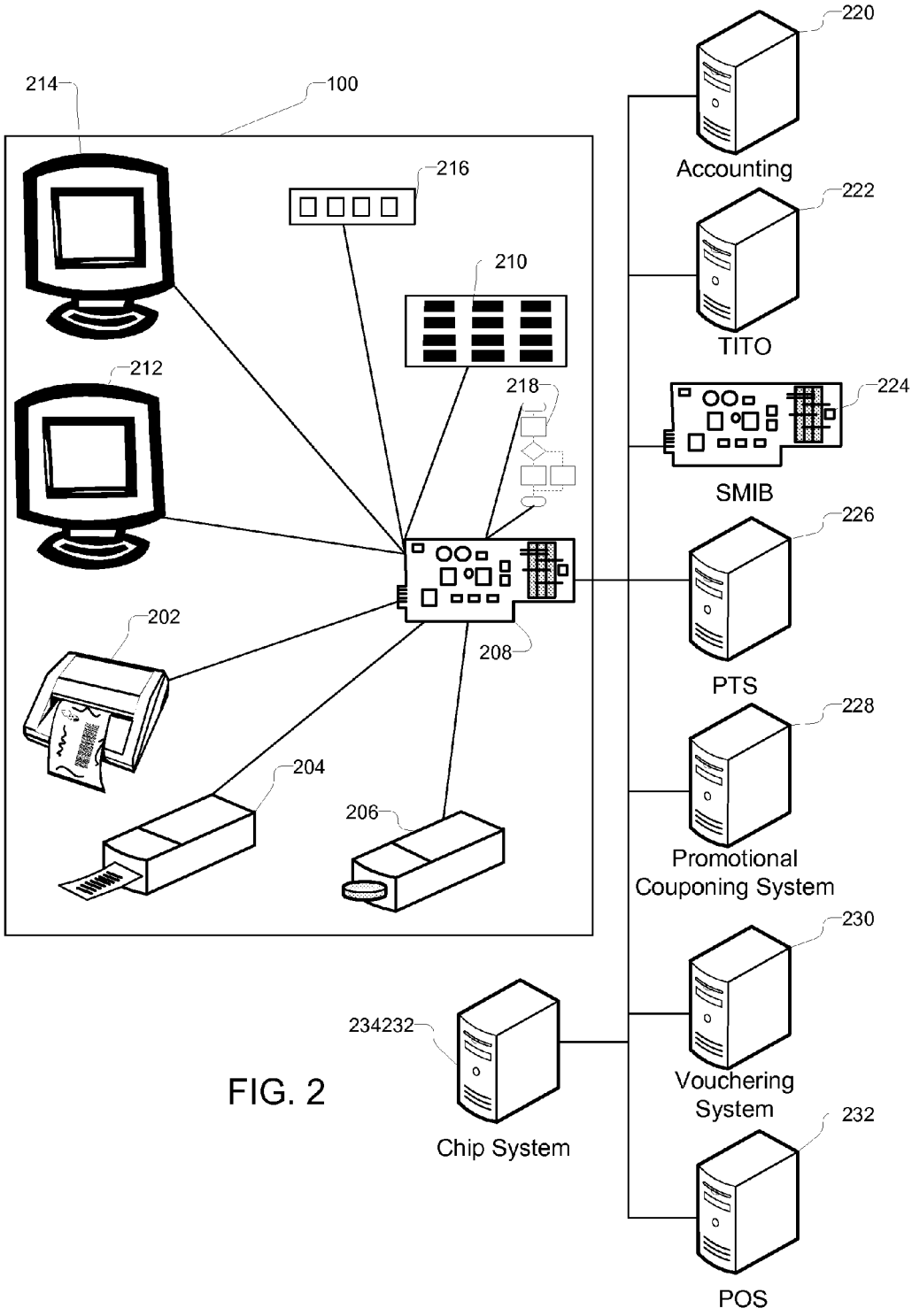
FIG. 2 is an illustration of the components of a gaming table device in a secured gaming table system in accordance with an exemplary embodiment of the present invention.

FIG. 2 is an illustration of the components of a gaming table device in a secured gaming table system in accordance with an exemplary embodiment of the present invention. As illustrated, a gaming table device 100 includes the following components: a bill validator and voucher reader 202, a voucher/coupon printer 204, a RFID sensing and/or reading mechanism 206, a controller 208, a keypad 210, a player display 212 a dealer display 214 and a user interface 216. Any or all of these components may be internal or external to the gaming table device.

The bill validator 202 is used to scan and validate paper currency or scan for the barcode of a gaming voucher or a promotional coupon upon receiving a cash-in or coupon-in signal. The barcode data may be transmitted to a host system for validation and verification.

In one embodiment of a gaming table device, bill validator accepts or rejects game vouchers and/or promotional coupons. The bill validator may scan the barcode and/or other indicia or data of each game voucher and/or promotional coupon inserted into the device for the validation and/or verification of such. The bill validator sends and receives signaling from one or more of host systems to verify and validate the redemption of a game voucher or promotional coupon inserted into a voucher scanning device. Additionally, the signaling may include device status, among others.

The voucher/coupon printer 204 is used to generate gaming vouchers and/or promotional coupons.

The RFID sensing and/or reading mechanism 206 is used for an RFID read of RFID chips, for instance, when the RFID chips are compiled or placed in a specified region on a gaming table. The RFID read of the chips may signal the gaming table device 100 as to the amount of a either a cash-in or a cash-out. The amount may be recorded in a memory of the controller 208 of the gaming table device and posted to the player display 212 or the dealer display 214 of the gaming table device.

The keypad 210 is used to receive input such as a cash-in amount, cash-out amount, a verification number, or a validation number, among others, from a dealer. The keypad allows dealer inputs for the secured validation and/or verification of game vouchers and/or promotional coupons inserted into the gaming table device 100 for redemption at a gaming table. The keypad may also serve as a secured means by which game vouchers, game voucher transactions, promotional coupons, promotional coupon transactions, a combination of any, or a combination of all is verified and/or validated at a gaming table. The transactions may include a "comp" given to a player or any win from a gaming table. Additionally, the keypad is used to request a cashout from a gaming table and/or provide the manual interface by which a player may play at a gaming table.

The user interface 216 is used to provide signaling which someone such as an operator or dealer might otherwise miss. An example user interface is an interface having feedback lights. Another example is an entry point or lit ring used to provide signaling to the dealer or player by flashing when chips are pushed into the gaming table device.

The dealer display 214 and player display 212 are used to provide visual means for data verification and/or validation, among other uses.

The controller 208 controls any or all operations of the gaming table device or any or all of the operations of any component thereof. In addition, a controller may exist for each component. The controller includes programming instructions 218 stored in a memory (not shown) of the controller for instructing the operations of the controller.

The foregoing description of the controller 208 of gaming table device 100 is provided by way of example and not of limitation, it being understood that controller 208 could be implemented in a variety of ways without deviating from the spirit of the invention. For example, the controller 208 could be constructed from hardware such as hardwired circuits in a single device or in multiple devices such as integrated circuits mounted on a printed circuit board. Alternatively, controller 208 could also be constructed from a combination of hardware and software components stored in a memory and that are executed by a processor.

The controller 208 may also include one or more interfaces (not shown) for communication with one or more host systems. The communications may include signaling such as a security code or authentication code for the verification and/or validation of the issuance and redemption of game vouchers or promotional coupons inserted into a bill validator or voucher scanning device at a gaming table.

As illustrated, a gaming table device may be coupled to one or more of the following system hosts or devices for data processing, data verification, and or data validation, among other operations: an accounting system 220, a TITO system 222, a Slot Machine Interface Board (SMIB) 224, a Player Tracking System (PTS) 226, a gaming chip issuance/redemption and/or tracking system 234, a promotional couponing system 228, a vouchering system 230, and a point-of-sale system (POS) 232, among other kinds of system hosts.

The accounting system 220 is used to process data related to any financial transaction that occurs within a gaming establishment and or associated gaming establishments.

The TITO system 222 is used to control the issuance and redemption of gaming vouchers for the cashless enabled games within a gaming establishment and or associated gaming establishments.

The Slot Machine Interface Board (SMIB) 224 is used to process data related to issuance and redemption of gaming vouchers and or promotional coupons.

The Player Tracking System (PTS) 226 is used to monitor game play activity by participating patrons. Additionally, data from the PTS is used by a gaming table device to personalize a promotional coupon.

A gaming chip issuance/redemption and/or tracking system 234 is used to monitor play activity at a gaming table. Additionally, gaming chips containing RFID may be electronically tracked by the system and read by the gaming table device.

A promotional couponing system 228 is used to create and manage promotional coupons in the gaming environment. The promotional couponing system is used to control and perform the printing of promotional coupons and other items of interest to patrons of a gaming establishment and or associated gaming establishments.

The vouchering system 230 is used to create cash-in and cash-out voucher records that are used by the gaming table device 100 and other gaming machines.

The point-of-sale (POS) system 232 may be installed in a gaming establishment in various locations where business is transacted, such as a retail shop, restaurant, ticket sales counter, front desk, etc. The POS is used to monitor and control transaction activity, typically through a cash register and other peripherals.

Other systems may include a lodging management system that monitors and tracks a patron's lodging within a gaming establishment and or associated gaming establishment.

The gaming table device 100 may be coupled to any system such as by a direct connection, indirectly connected through another coupled system, or connected through a slot machine interface board (SMIB). The connection to a system may use a standard game protocol. In a variation, the connection may use a nonstandard game protocol. In addition, a gaming table device may be coupled to any system using a plurality of connections such as a serial connection, a network connection, or a wireless connection.

In another embodiment, the voucher/coupon printer, bill validator, interface such as a display, and keypad are coupled to a controller or other interface, with the controller or other interface coupled to one or more of the host systems.

In another embodiment, each component may be coupled to a separate controller or other interface where each controller or other interface may be internal or external to each device. The plurality of controllers or other interfaces may be coupled to one or more of the host systems.

One or more of host systems may communication with one or more of the other host systems for the validation and/or verification of the issuance and/or redemption of one or more of game vouchers and/or promotional coupons. Additionally, one or more of host systems may transmit data related to game vouchers, game voucher transactions, promotional coupons, promotional coupon transactions, etc. to the other hosts or the gamine table device.

Figure 3:
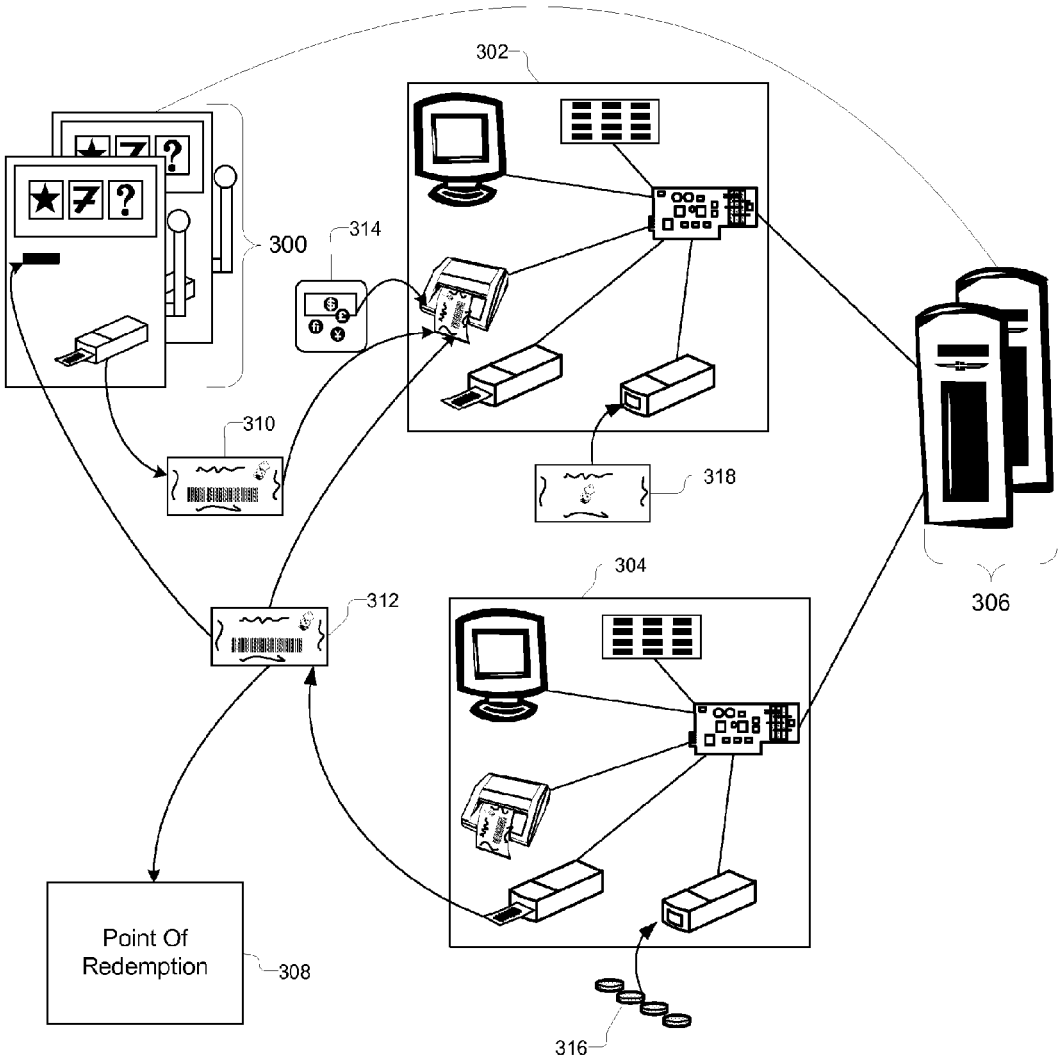
FIG. 3 is an illustration of the use of vouchers, RFID chips, RFID cards and promotional coupons issued and redeemed in a secured gaming table vouchering system in accordance with an exemplary embodiment of the present invention.

FIG. 3 is an illustration of the use of vouchers, RFID chips, RFID cards and promotional coupons issued and redeemed in a secured gaming table vouchering system in accordance with an exemplary embodiment of the present invention. A secured gaming table vouchering system includes one or more gaming machines 300, such as a slot machine having a bill acceptor/validator and gaming table device, among other components not shown. The secured gaming table vouchering system includes one or more gaming table devices, such as gaming table devices 302 and 304. The gaming machines and gaming table devices are coupled to one or more of host systems 306. In operation, the gaming machines and the gaming table devices generate and use vouchers and coupons, such as vouchers 310 and 312.

The secured gaming table vouchering system may also include a point of redemption 308 such as a kiosk, point-of-sale, cashier's cage, or other location where a player can redeem a game voucher or promotional coupon.

A player may cash-in at a gaming table using a gaming table device. The gaming table devices accept currency 314, RFID chips 316, RFID cards 318 and the gaming vouchers. The gaming vouchers may come from another gaming table device or from one of the gaming machines. When a player cashes-out, the gaming table devices are used to generate a voucher or coupon that may then be read by one of the gaming machines for a cash-in or redeemed at a point of redemption.

Figure 4:
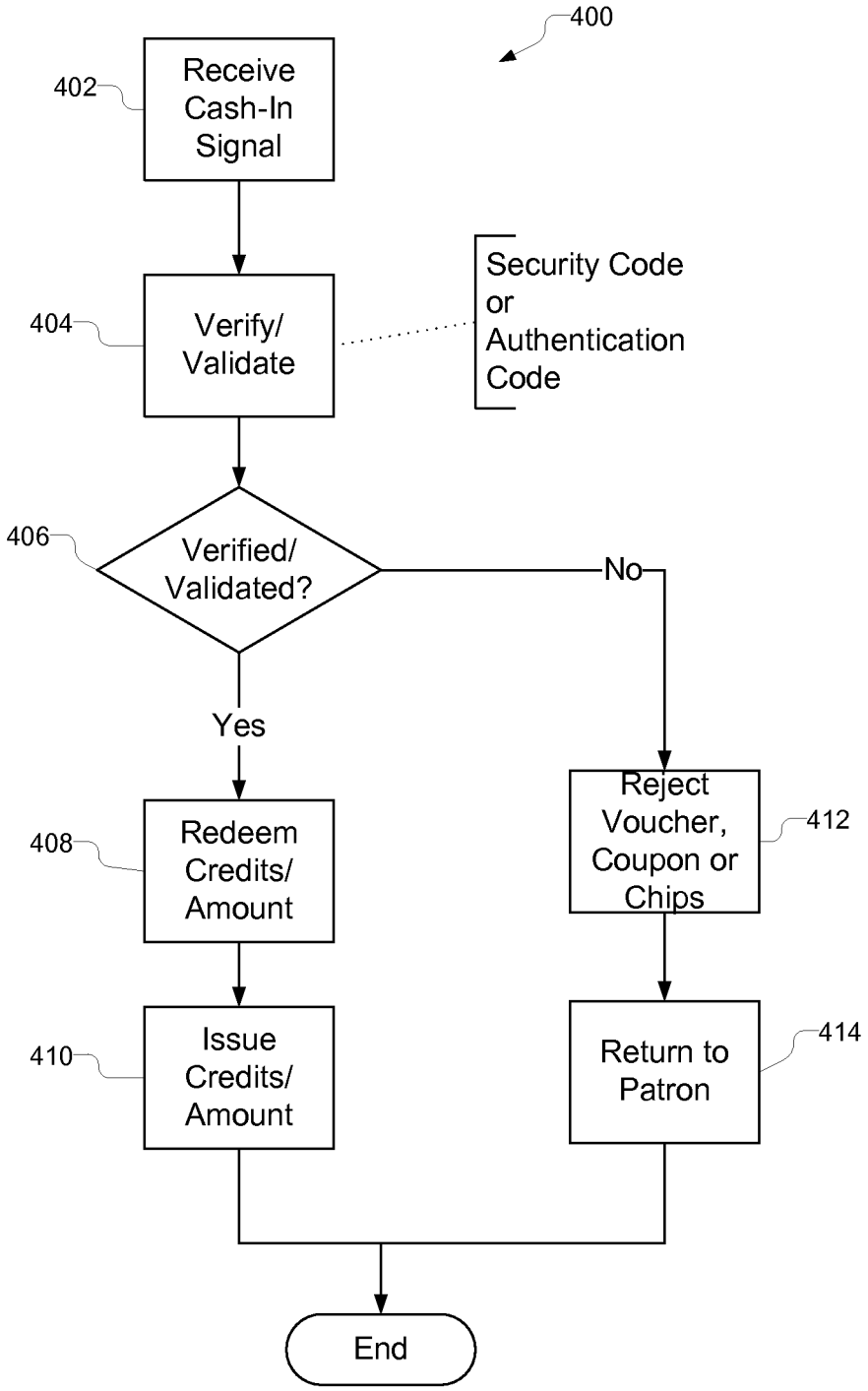
FIG. 4 is a diagram of a cash-in verification and validation process in accordance with an exemplary embodiment of the present invention.

FIG. 4 is a diagram of a cash-in verification and validation process in accordance with an exemplary embodiment of the present invention. As illustrated, the process 400 begins with receiving (402) a cash-in signal (which may determine that a game voucher and/or promotional coupon was inserted into a bill validator or voucher scanning device coupled to a gaming table for redemption or that RFID chips or an RFID Card was presented or that cash is being used as an initial cash-in). The process then verifies (404) the amount of cash in or validates the voucher or coupon that was presented. A security code or other authorization code may also be entered using a keypad or the code may be generated by one or more of host systems as shown in FIG. 2. Any or all the data or contents of the game voucher and/or promotional coupon may be verified and validated against data from one or more of host systems. The data or contents may include a validation number, a date, a time, a ticket number, a void after period, and a barcode.

If the RFID items, cash, game voucher or promotional coupon or contents thereof are verified (406) or validated, the process continues to redeem (408) credits/amount where one or more of host systems may signal a gaming table device to redeem the voucher or coupon. Thereafter, the appropriate amount of credits is issued (410) to a player in the form of cash, gaming table tokens, or electronic credit.

If for any reason one or more of host systems cannot verify or validate the game voucher or promotional coupon or contents thereof, the voucher or coupon is rejected (412) and may be returned to the player (414).

In one variation, should verification or validation fail, such as the validation codes on the presented item is identified as invalid or already used, the gaming voucher or promotional coupon may not be returned to the customer. Instead, an alert signal may be sent to one or more of personnel at the gaming table or elsewhere in a gaming establishment. Additionally, one or more of host systems such as an accounting system may flag that unique ID in the database to identify that unique ID as potentially being used for counterfeiting.

Additionally, the value of the gaming voucher or promotional coupon may also be indicated on one or more of the displays of a gaming table machine.

In the operation of another embodiment, the actual value or a determined value of the gaming voucher or promotional coupon may be indicated by an entry point, user interface, or external display. For example, a gaming establishment may determine that any gaming voucher or promotional coupon with a value of $200 may be eligible for a certain promotion. When a customer having a gaming voucher meeting this requirement inserts the gaming voucher into the entry point of a gaming table device, the entry point, user interface, or external display may provide flashing lights or some other visual indicator for eligibility for the promotion.

Figure 5:
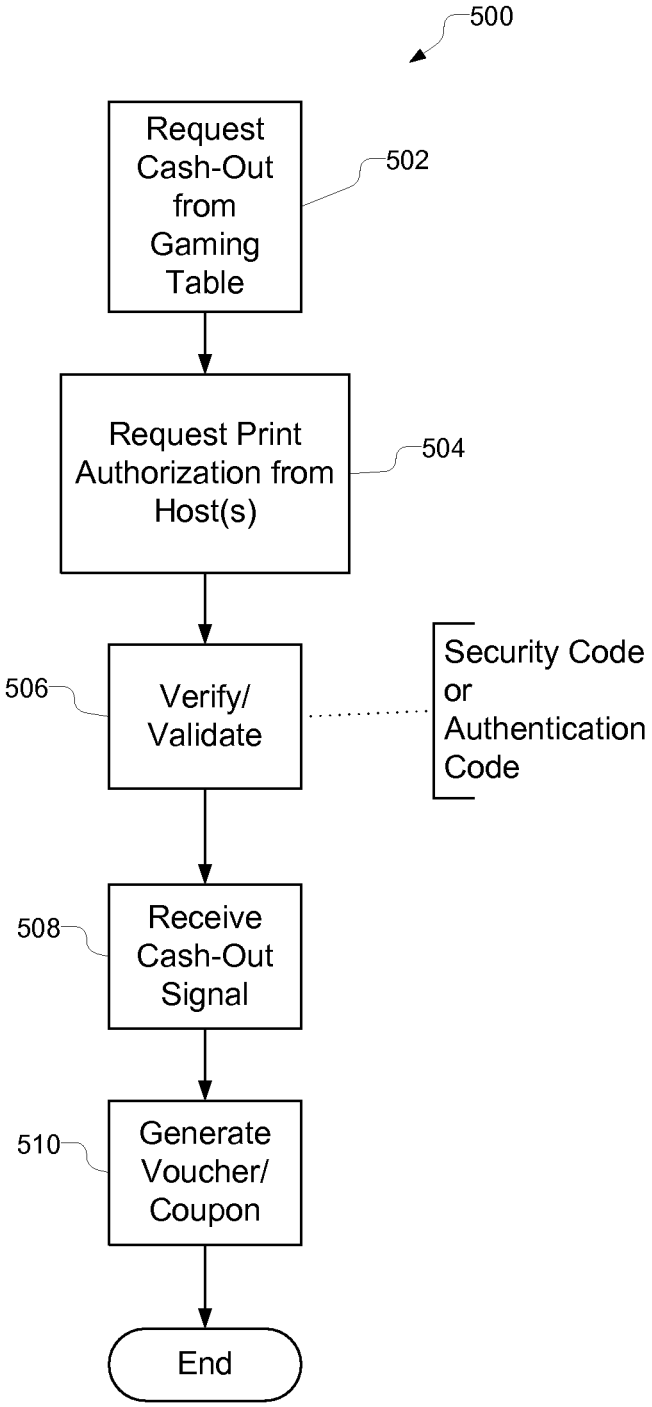
FIG. 5 is a diagram of the cash-out verification and validation process in accordance with an exemplary embodiment of the present invention.

FIG. 5 is a diagram of the cash-out verification and validation process in accordance with an exemplary embodiment of the present invention.

As illustrated, the process 500 begins with a request of cash-out (502) from a gaming table device, which may be initiated by a player pressing a cash-out button similar to that of a slot machine. The process continues with request print authorization (502) from one or more of the system hosts of FIG. 2 where the gaming table device may receive signaling from one or more of host systems to authorize the generation of a game voucher or promotional coupon.

The process then attempts to verify or validate (506) the cash-out request. To do so, a security code or authorization code may be entered using a keypad of the gaming table device or the code may be generated by one or more of the host systems. Any or all the data or contents of the game voucher and/or promotional coupon may be verified and validated against data from one or more of host systems. The data or contents may include a validation number, a date, a time, a ticket number, a void after period, and a barcode or other such information.

In a receive cash-out signal (508), one or more of host systems may signal a gaming table or a printer coupled to the gaming table to generate the appropriate amount of credits in the form of a game voucher or promotional coupon that is generated (510) by the process.

In one embodiment of a cash-out process, the cash-out is similar to when a customer presses the cashout button on a slot machine or other gaming machine, at the end of a game when chips are cashed in or at the end of a transaction for goods and or services that require change to be paid to the customer, a cash-out signal such as the one later disclosed in FIG. 4 is processed. A unique ID and possibly additional data then may be transmitted to the requesting gaming table device where the requesting gaming table device may generate a gaming voucher or promotional coupon using the unique ID.

Additionally, a user such as a gaming table dealer may enter the amount of money to be returned to the customer using a keypad. Using a user interface or external display, a user may also visual verify the entered amount. In this embodiment, if the value exceeds the approved limit for a dealer, a gaming table supervisor may use the keypad to authorize the transaction. Once the value is entered, the gaming table device may request a unique ID from one or more of host systems for the value of the transaction.

Figure 6:
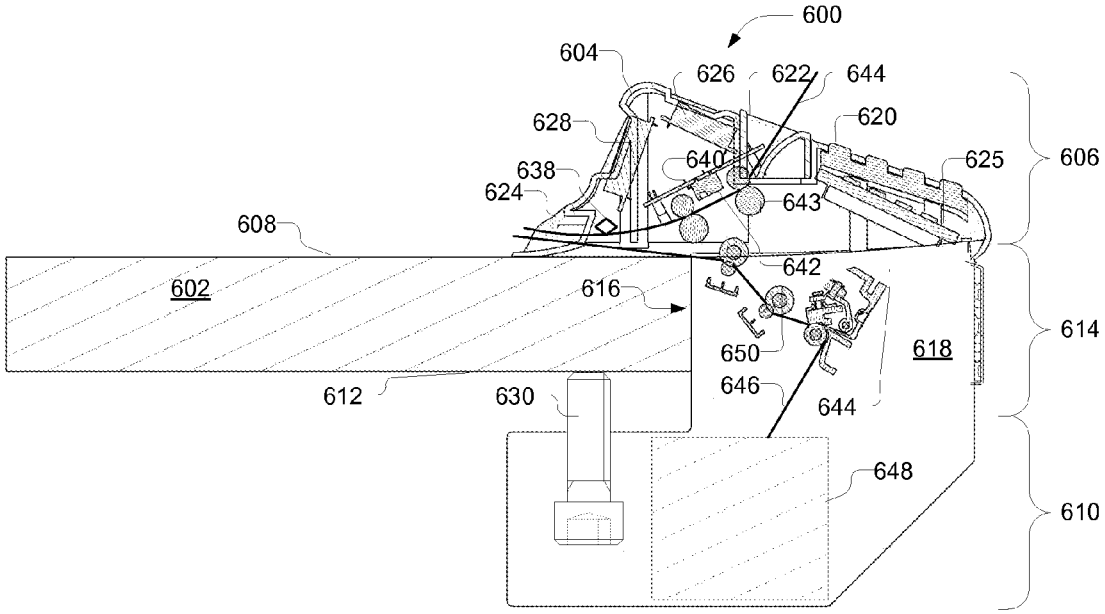
FIG. 6 is a cross sectional view of a gaming table device used in a secured gaming table vouchering system in accordance with an exemplary embodiment of the present invention.

FIG. 6 is a cross sectional view of a gaming table device used in a secured gaming table vouchering system in accordance with an exemplary embodiment of the present invention.

The gaming table device 600 is shown mounted to a gaming table 602. The gaming table device has an outer housing 604 having an upper portion 606 that extends over a upper or playing surface 608 of the gaming table, a lower portion 610 that extends below a lower surface 612 of the gaming table, and a middle portion 614 adjacent to an edge surface 616 of the gaming table and located between the upper portion and the lower portion. The housing has an interior portion 618 and an exterior surface 620 with a first opening 622 and a second opening 624 extending through the exterior surface into the interior portion. The openings are located on the upper portion 606 with the first opening 622 accessible to a dealer at the gaming table and the second opening 624 accessible to a player at the gaming table. The upper portion 606 of the gaming table device further includes a keypad or keyboard 625 proximate to the first opening for use by the dealer and a dealer display 626 viewable by the dealer. The upper portion 606 also includes a player display 686 proximate the second opening and viewable by the player.

As illustrated, the gaming table device 600 is removably connected to the gaming table 602 by being mounted at an edge surface 616 of the gaming table. In this embodiment of a gaming table device, the gaming table device is secured by a screw clamp 630 extending upwardly from the bottom portion 610 of the housing toward the upper portion 606 with the gaming table clamped therebetween. The clamping system allows for an adjustable, flexible, and repositionable mount, thereby allowing the secured gaming table device to be moved to another location on the same gaming table or moved to another gaming table. This mounting arrangement does not require modification to the gaming table in order to accommodate the gaming table device.

In another embodiment of a gaming table device, the secured gaming table vouchering system is mounted in an opening (not shown) in the gaming table used for an existing drop box of the gaming table. In this embodiment, the gaming table device may replace the use of existing drop boxes.

The gaming table device also includes an RFID reader 632 located in the interior portion 618 of the housing 604 and proximate to the second opening 624. The RFID reader is used to perform a RFID scan on, for example, a rewritable card with RFID or RFID gaming chips.

The table gaming device further includes one or more printed circuit boards 640 in the interior portion 618. The printed circuit boards are for the mounting of a controller and other electronic components such as one or more interfaces (not shown) used to send and receive signaling to and from one or more host systems to generate game vouchers and/or promotional coupons as previously described.

A bill validator/voucher scanner 642 is mounted in the interior portion of the housing. The bill validator receives printed items such as paper currency, vouchers, coupons and the like 644 via the first opening and transports the items out of the housing via the second opening 624. The bill validator may further receive printed items via a bulk note feeder (not shown). The bulk note feeder is used to process a plurality of notes or currency in one feed or run instead of processing one note or currency at a time. In operation, a stack of notes or currency is placed in the bulk note feeder after which the gaming table device may pull each note or currency for processing.

The gaming table device 600 further includes a voucher or coupon printer 644 mounted in the interior portion 618 of the housing. The printer receives print media 646 from a media supply storage area 648 located in the bottom portion 610 of the housing. Once the printer prints a coupon or voucher, the coupon or voucher is transported via pinch rollers 650 to the second opening 624 where the coupon or voucher is presented to the player.

The dealer and player displays constitute a dual display interface for interfacing with a host system or plurality of such for the issuance, redemption, validation, and verification of game vouchers and/or promotional coupons at a gaming table. Additionally, the plurality of displays can indicate to a player and/or dealer the amount of an inserted voucher. Additionally, the value of the gaming voucher or promotional coupon may also be indicated on a display. Additionally, a user may use a display to verify an amount. Additionally, a display is used to show when an error occurs with the gaming table device.

In another embodiment, the interface such as a display is a single display interface.

The keypad is used to receive input such as a cash-in amount, cash-out amount, a verification number, or a validation number, among others. The keypad may be used for secured validation and/or verification of game vouchers and/or promotional coupons inserted for redemption at a gaming table. Additionally, the keypad is used to enter a security code or authentication code. Additionally, the keypad may include extra keys, which can be used to customize the keypad. For example, one button on the keypad may be programmed to contact a pit boss; another button may be programmed to contact the bar; and another button may be programmed to contact security. Additional detail on the keypad is disclosed throughout this specification.

Entry points or lit rings (not shown) proximate to the first and second openings maybe be used to provide signaling to the dealer or others, for instance, flashing when chips are pushed in. In another example, vouchers and/or promotional coupons are inserted into the entry point. In another example, currency and/or notes are inserted into the entry point.

In another embodiment, the gaming table device may include multiple entry points, for example, one entry point for vouchers, coupons, and currency and another entry point for media such as rewritable cards and player tracking cards, among others.

The scanning device may further include a mechanism to accept or reject game vouchers and/or promotional coupons. In another embodiment, the scanning device may include an optical scanning device and/or other means to scan rewritable media, such as rewritable cards and/or player tracking cards.

In one embodiment of a gaming table device, the gaming table device does not include a media intake storage area. In this embodiment, media such as vouchers and/or promotional coupons may be returned to the dealer or player after being scanned. For example, the media can be reprinted with a void pattern over the existing indicia.

The media supply storage area is used to store blank media that the gaming table device uses to generate additional vouchers and/or promotional coupons.

Figure 7:
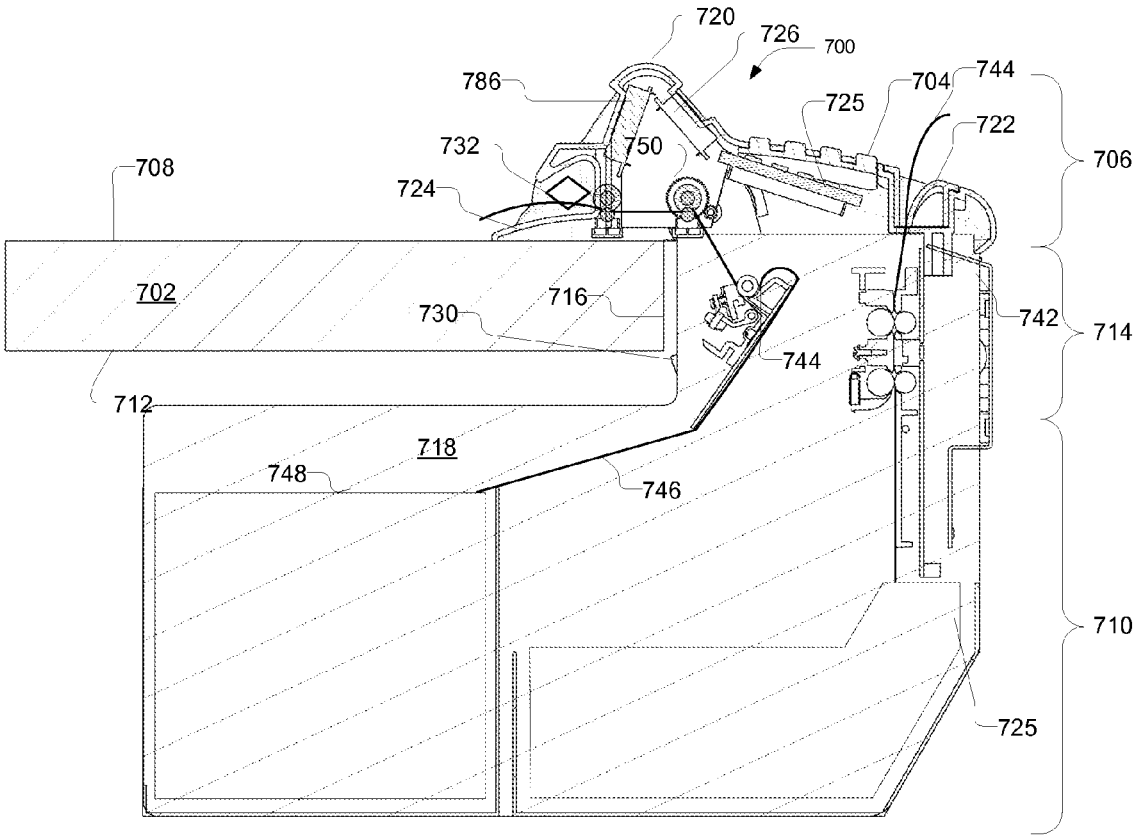
FIG. 7 is a cross sectional view of a gaming table device used in a secured gaming table vouchering system in accordance with another exemplary embodiment of the present invention.

FIG. 7 is a cross sectional view of a gaming table device used in a secured gaming table vouchering system in accordance with another exemplary embodiment of the present invention. The embodiment of FIG. 7 differs from the embodiment of FIG. 6 in that the components in the housing of the gaming table device are organized differently; however, the operation of the components is substantially the same with some small differences as noted below.

The gaming table device 700 is shown mounted to a gaming table 702. The gaming table device has an outer housing 704 having an upper portion 706 that extends over a upper or playing surface 708 of the gaming table, a lower portion 710 that extends below a lower surface 712 of the gaming table, and a middle portion 714 adjacent to an edge surface 716 of the gaming table and located between the upper portion and the lower portion. The housing has an interior portion 718 and an exterior surface 720 with a first opening 722 and a second opening 724 extending through the exterior surface into the interior portion. The openings are located on the upper portion 706 with the first opening 722 accessible to a dealer at the gaming table and the second opening 724 accessible to a player at the gaming table. The upper portion 706 of the gaming table device further includes a keypad or keyboard 725 proximate to the first opening for use by the dealer and a dealer display 726 viewable by the dealer. The upper portion 706 also includes a player display 786 proximate the second opening and viewable by the player.

As illustrated, the gaming table device 700 is removably connected to the gaming table 702 by being mounted at an edge surface 716 of the gaming table. In this embodiment of a gaming table device, the gaming table device is secured by a latching mechanism 730. The latching mechanism allows for an adjustable, flexible, and repositionable mount, thereby allowing the secured gaming table device to be moved to another location on the same gaming table or moved to another gaming table.

The gaming table device also includes an RFID reader 732 located in the interior portion 718 of the housing 704 and proximate to the second opening 724. The RFID reader is used to perform a RFID scan on, for example, a rewritable card with RFID or RFID gaming chips.

The table gaming device further includes one or more printed circuit boards (not shown) in the interior portion 718. The printed circuit boards are for the mounting of a controller and other electronic components such as one or more interfaces (not shown) used to send and receive signaling to and from one or more host systems to generate game vouchers and/or promotional coupons as previously described.

A bill validator/voucher scanner 742 is mounted in the interior portion of the housing. The bill validator receives printed items such as paper currency, vouchers, coupons and the like 744 via the first opening and transports the items into a media intake storage area 725 located in the bottom portion of the housing. Media such as vouchers and promotional coupons as well as currency and/or chips are captured and stored in the media intake storage area. The media intake storage area is secured and removable. Additionally, the secured means can be by one or more locks and keys. In operation, a person such as a pitboss may use a key to unlock the media intake storage area for removal, for example, to remove the contents of the media intake storage area. Once the contents are removed, the media intake storage area may be returned to the gaming table device and secured with lock and key.

The bill validator may further receive printed items via a bulk note feeder (not shown). The bulk note feeder is used to process a plurality of notes or currency in one feed or run instead of processing one note or currency at a time. In operation, a stack of notes or currency is placed in the bulk note feeder after which the gaming table device may pull each note or currency for processing.

The gaming table device 700 further includes a voucher or coupon printer 744 mounted in the interior portion 718 of the housing. The printer receives print media 746 from a media supply storage area 748 located in the bottom portion 710 of the housing. Once the printer prints a coupon or voucher, the coupon or voucher is transported via pinch rollers 750 to the second opening 724 where the coupon or voucher is presented to the player.

In another embodiment, the gaming table device consists of separate casings, which are connected securely and removably to each other. For example, one casing houses components such as the printer, scanning device, displays, and keypad, among others; and another casing houses components such as the media intake storage area and/or the media supply storage area. In this embodiment, the casings can be connected securely using a hinged or other mechanism. This embodiment allows for the quick disconnect and change of one casing for servicing without affecting the use of the other casing. For example, the casing for the media intake storage area can be separated from the other casing which houses the keypad, among others to be replaced with another casing for the media intake storage area without affecting the game play.

Although the present invention has been described in certain specific embodiments, many additional modifications and variations would be apparent to those skilled in the art. It is therefore to be understood that this invention may be practiced otherwise than as specifically described. Thus, the present embodiments of the invention should be considered in all respects as illustrative and not restrictive, the scope of the invention to be determined by any claims supportable by this application and the claims' equivalents rather than the foregoing description.

What is claimed is:

1. A gaming table device, comprising:

a housing having an interior portion and an exterior surface with a first and second opening extending through the exterior surface into the interior portion, the first opening accessible to a dealer at a gaming table and the second opening accessible to a player at the gaming table;

a voucher validator located in the interior portion of the housing and configured to read gaming vouchers received through the first opening;

a dealer keyboard proximate to the first opening;

a dealer display visible to the dealer operating the gaming table device via the dealer keyboard;

a voucher/coupon printer located in the interior portion of the housing and configured to print a voucher and present the voucher to the player via the second opening;

a player display visible to the player and mounted on the housing proximate to the second opening;

a first communication interface located in the interior portion and coupled to a ticket-in ticket-out (TITO) system;

a second communication interface located in the interior portion and coupled to a gaming chip issuance, redemption and tracking system; and a controller located in the interior portion and coupled to the voucher validator, the dealer keyboard, the dealer display, the player display, the voucher/coupon printer, a player tracking card reader, and the first, second and a third communication interfaces, wherein the controller is constructed to:

validate a voucher using the voucher validator and the coupled TITO system to determine a cashin amount for the player;

issue credits to the player for the cashin amount for use at the gaming table:

display the amount of the issued credits to the dealer using the dealer display and to the player using the player display;

receive a cashout amount for the player using the keyboard; and print a voucher for the player for the cashout amount using the voucher printer and the coupled TITO system.

2. The gaming table device of claim 1, wherein, the voucher validator is further configured to transport validated vouchers to a media intake storage location in the interior portion of the housing, and the dealer keyboard is located between the first opening and the dealer display.

3. The gaming table device of claim 1, wherein, the voucher validator is further configured to present validated vouchers via the second opening, and the first opening is located between the dealer display and the keyboard.

4. The gaming table device of claim 1, further comprising an RFID chip reader located in the interior portion for reading an RFID chip received through the second opening, wherein the controller is further constructed to determine a cashin amount using the RFID chip reader.

5. The gaming table device of claim 1, further comprising an RFID card reader located in the interior portion for reading an RFID card received through the second opening.

6. The gaming table device of claim 1, further comprising a clamp for removably attaching the gaming table device to a gaming table.

7. The gaming table device of claim 1, further comprising a communication interface coupling the gaming table device to a SMIB.

8. The gaming table device of claim 1, wherein credits are issued to the player in the form of cash.

9. The gaming table device of claim 1, wherein credits are issued to the player in the form of gaming table tokens.

10. The gaming table device of claim 9, further includes a third communication interface coupling the gaming table device to a gaming chip issuance, redemption and tracking system.

11. The gaming table device of claim 1, wherein credits are issued to the player in the form of electronic credit.

* * * * *